United States Patent [19]

Lieber

[11] 4,152,801

[45] May 8, 1979

[54] SWIMMING POOL DEBRIS COLLECTION APPARATUS

[76] Inventor: Victor Lieber, 6558 Lasaine Ave., Van Nuys, Calif. 91406

[21] Appl. No.: 867,220

[22] Filed: Jan. 6, 1978

[51] Int. Cl.[2] ..... E04H 3/20; B01D 33/34

[52] U.S. Cl. ..... 15/1.7; 210/407

[58] Field of Search ..... 15/1.7; 210/407, 470

[56] References Cited

U.S. PATENT DOCUMENTS

| | | | |
|---|---|---|---|
| 2,902,705 | 9/1959 | Eistrup | 15/1.7 |
| 3,220,037 | 11/1965 | Ruhling | 15/1.7 |
| 3,368,686 | 2/1968 | Petrik | 210/407 |
| 4,003,100 | 1/1977 | Whitaker | 15/1.7 |
| 4,013,563 | 3/1977 | Petrik | 15/1.7 X |

*Primary Examiner*—Edward L. Roberts

*Attorney, Agent, or Firm*—Jack C. Munro

[57] ABSTRACT

A swimming pool debris collection apparatus which includes therewith a device for disturbing debris causing such to be dislodged from the bottom surface of a swimming pool and suspended a short distance above the bottom surface of the pool to facilitate entry into a collecting chamber. The collecting chamber comprises a mesh wall structure which is attached to a rigid polygonal shaped frame. Attached to the frame and located upstream is the debris disturbing device which when in use will rest against the bottom surface of the pool to initially effect the disturbing of the debris and its entry into the collecting chamber. The debris disturbing device is attached by a bracket to the frame and is capable of pivotal movement in respect thereto.

4 Claims, 4 Drawing Figures

SWIMMING POOL DEBRIS COLLECTION APPARATUS

BACKGROUND OF THE INVENTION

The field of this invention relates to a device for collecting debris and more particularly to a device which facilitates collecting of debris which is located beneath a body of water such as on the bottom surface of a swimming pool.

It is well known that within swimming pools, leaves, sticks and other similar types of debris pass through the water and will rest on the bottom surface of the swimming pool. The normal cleaning device for the bottom of a swimming pool is a vacuuming device which transports the debris into the filtering mechanism for the pool. Large debris such as leaves, sticks and the like, tend to decrease the effectiveness of the vacuum operation. Therefore, it would be preferable to remove such large debris prior to vacuuming.

At the present time, a long handled device which has a frame attached to the outermost end of the handle with a mesh type of net being attached to the frame is employed to collect large sized debris from a swimming pool. To move such a device along the bottom of the swimming pool causes the device to be moved over the debris, not collecting it, and creates a turbulent water condition which tends to lift the debris off the bottom surface of the pool to suspend such within the water and be dispersed over a wide area behind the device. Therefore, the collection of the debris is not only not accomplished but is made substantially more difficult.

There is a definite need for a manually operated device which is capable of removing debris from the bottom surface of the swimming pool with a significantly greater efficiency than presently available.

SUMMARY OF THE INVENTION

The structure of this invention is to be summarily described in the Abstract of the Disclosure and reference is to be had thereto.

The structure of this invention comprises a debris collection apparatus for the bottom of the swimming pool which causes turbulent debris lifting currents just upstream of the collecting chamber permitting the debris to pass directly into the chamber and be accumulated.

Another advantage of the structure of the invention is that the structure can be readily attached to the existing debris collection device which then causes the prior art device to be employed in a substantially more efficient manner.

Another feature of this invention is that the device is constructed of few parts which can be manufactured and sold inexpensively.

DETAILED DESCRIPTION OF THE SHOWN EMBODIMENT

Figure 1:
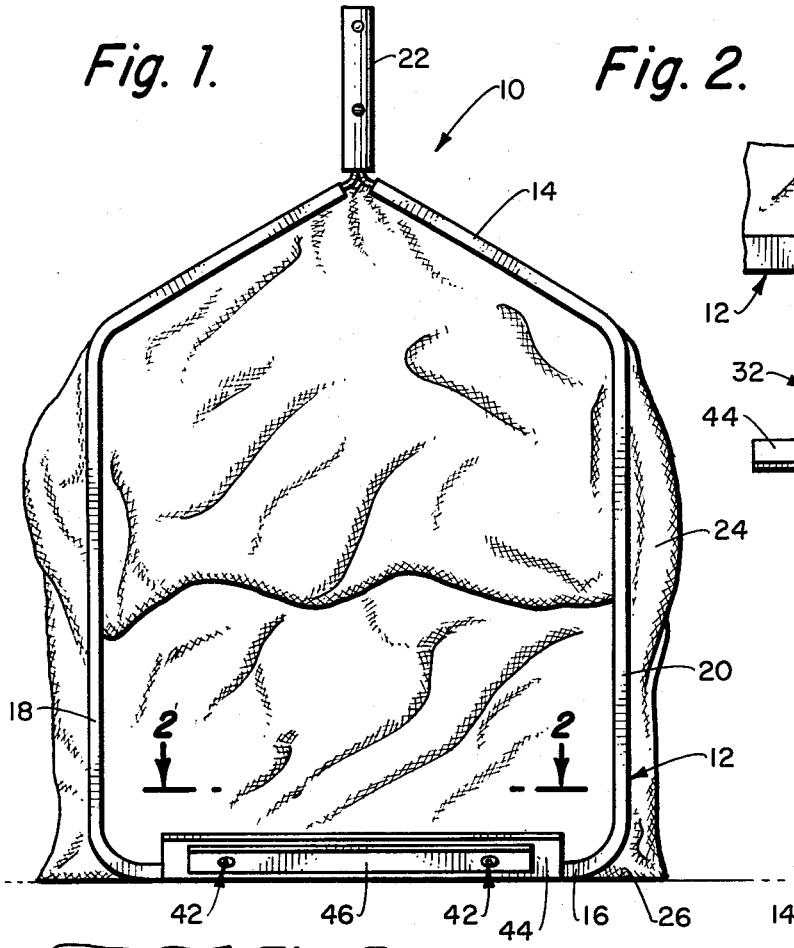
FIG. 1 is a front view of the debris collection apparatus of this invention showing the apparatus in the collecting position.
Figure 2:
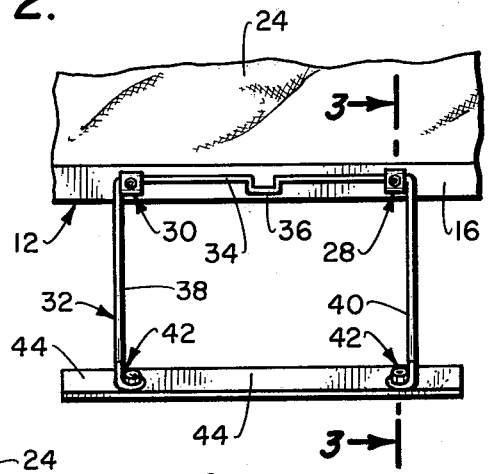
FIG. 2 is a partial plan view of the debris collection apparatus of this invention taking along line 2—2 of FIG. 1.
Figure 3:
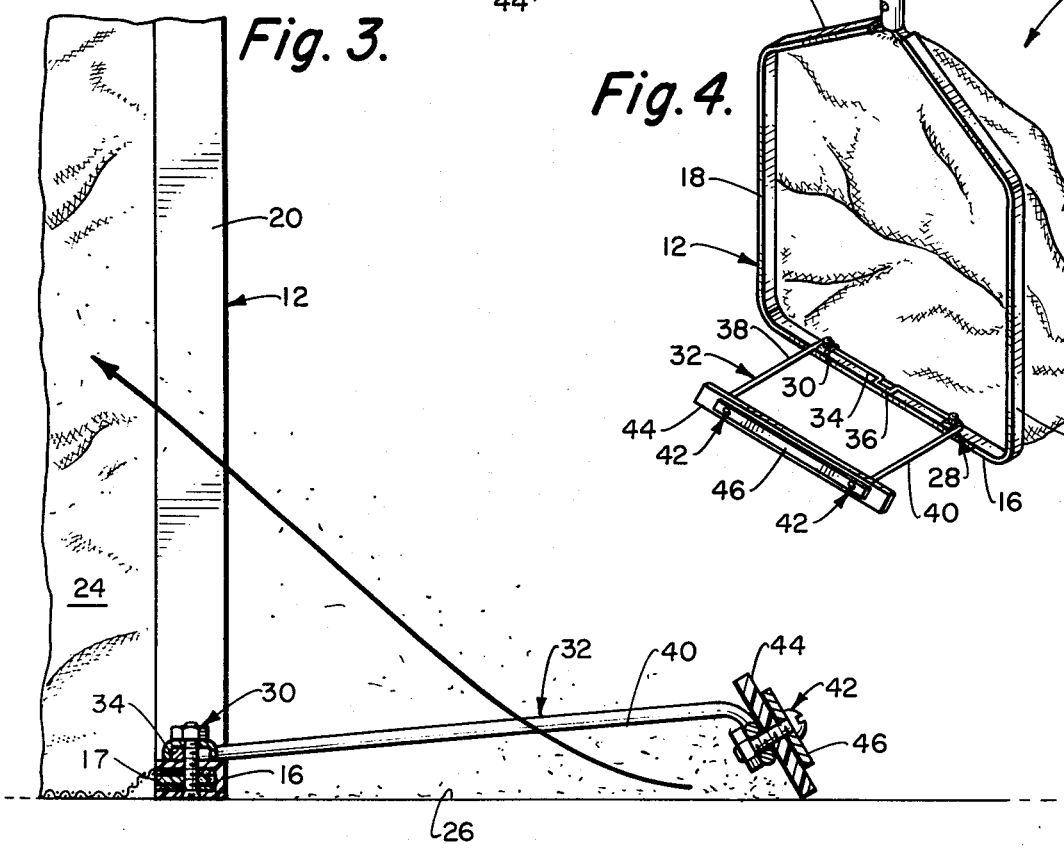
FIG. 3 is a side cross-sectional view of the debris collection apparatus of this invention taken along line 3—3 of FIG. 2.
Figure 4:
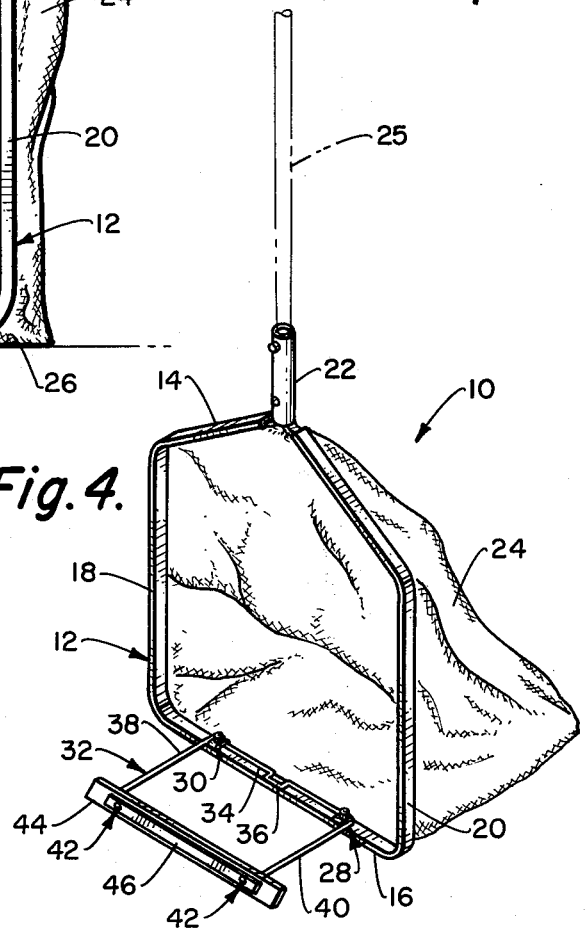
FIG. 4 is an isometric view of the debris collection apparatus of this invention showing such in the debris collecting position.

Referring particularly to the drawing there is shown the debris collection apparatus 10 of this invention which comprises a rigid polygonal shaped thin frame 12 which has a top side 14, bottom side 16 and side members 18 and 20. The frame 12 can be constructed of any rigid material such as plastic, metal or the like.

Attached to the upper side 14 is a handle attaching bracket 22. An elongated handle member 24 is to be connectable to the bracket 22.

A debris collection structure shown in the form of a net 24 or other open mesh structure is attached entirely around the frame 12 on the rear side thereof. Net 24 will be permanently attached by some conventional means to the frame 12.

The lower surface 16 of the frame 12 comprises a substantially flat member which is adapted to rest against the bottom surface 26 of the pool. Attached to a bottom member 16 by a pair of fastener assemblies 28 and 30 is a wire rod bracket 32. The fastener assemblies 28 and 30 each comprise a conventional nut and bolt fastener which cooperate with a thin sheet metal member to secure the rod bracket 32 to the member 16. The base member 34 of the bracket 32 is attached directly to the member 16. This base member includes a protruding section 36. The protruding section 36 is to limit the downward motion of the bracket 32 with respect to the frame 12. It is to be understood that the bracket 32 is capable of pivoting movement with respect to the member 16 of the frame 12.

It is normally desired that the downward motion be limited to the arms 38 and 40 of the bracket 32 extend substantially at a right angle with respect to the plane of the enlarged opening formed within the frame 12. Normally, there is no need to limit the upward pivoting motion. However, an upward stop may be employed if such is desired.

Attached by conventional bolt and nut fasteners 42 to the free end of the arms 38 and 40 is an elongated member 44. The elongated member 44 will normally be constructed of a plastic material, nylon, rubber or possibly even metal. Preferably the material should be not capable of making marks or scratches upon the bottom surface 26 of the pool.

A thin metallic plate 46 is located adjacent to the member 44 to maintain the member 44 substantially rigid. The longitudinal axis of the member 44 is located substantially parallel to the member 16 and also parallel to the plane of the enlarged opening formed by the frame 12.

The operation of the debris collection apparatus of this invention is as follows: The device 10 is placed within the water of the swimming pool with the member 16 located directly adjacent to the bottom of the pool. In this position the debris disturber in the form of member 44 is also located against the bottom edge of the pool. The user then proceeds to move the entire apparatus forward in the direction of the path to be cleaned. The member 44 first comes into contact with the debris by passing over the debris. The small amount of turbulence created by the member 44 passing over the debris causes the debris to be suspended within the water a short distance above the bottom surface 26. The large open area between the member 44 and the member 16 provided by the wire bracket 32 facilitates the suspension of the debris. Further forward movement of the apparatus causes the debris to be moved through the enlarged opening created by the enclosed frame 12 and into the debris collection device in the form of the net 24. The amount of debris collected by the apparatus of this invention is substantially greater than heretofore possible due to the inclusion of the debris disturber in the form of the elongated member 44. If the frame 12 assumes various angular positions with respect to the surface 26 of the pool, the debris disturber 44 will remain in contact with the surface 26 due to being pivotly supported with respect to the frame member 16. It has been found that the most desireable situation occurs with the elongated member 44 being located approximately six inches forward of the member 16.

It is considered to be within the scope of this invention that the frame 12 could be formed in other configurations such as circular if desired. Also, the debris disturber in the form of solid member 44 may be modified to be in the form of a small frame member having a hollow center, or other configurations may be found to be desireable.

What is claimed is:

1. A swimming pool debris collection apparatus comprising:

an enclosed frame having an enlarged center opening, said frame having a front side and a rear side;

an elongated handle attached to said frame;

a debris collecting means attached to said rear side of said frame along the entire length of said frame, the wall structure of said debris collecting means permitting passage of water therethrough but retains solid material of a certain size or greater;

a debris disturber connected by attaching means to said front side of said frame, said debris disturber including an elongated member located spaced from said front side of said frame opposite said debris collecting means, said elongated member to be in physical contact with the bottom surface of the swimming pool as the frame is moved therealong which results in debris located against the bottom surface becoming dislodged and temporarily suspended in the water a short distance above the bottom surface to facilitate entry into the enlarged opening and collection by said debris collecting means;

said attaching means comprising a bracket, said bracket comprising a narrow member interconnecting said elongated member and said frame in such a manner so as to produce a substantial amount of open area between said elongated member and said frame, whereby said bracket does not hinder or prevent the disturbing of debris and the suspending of the debris within the water after passage of said elongated member thereover; and said bracket being pivotly mounted to said frame so as to permit said debris disturber to be located against the bottom surface of the swimming pool regardless of the angular position assumed by said frame with respect to the bottom surface of the swimming pool.

2. Apparatus as defined in claim 1 including:

stop means located between said bracket and said frame, said stop means for limiting the downward pivotal motion of said elongated member in respect to said frame.

3. Apparatus as defined in claim 2 wherein:

said elongated member having a longitudinal center axis, said longitudinal center axis of said elongated member being located substantially parallel to the plane defining said enlarged center opening.

4. Apparatus as defined in claim 2 wherein:

said frame having an upper side and a bottom side each of which are interconnected by a pair of frame side members, said top side being connected to said handle, said bottom side adapted to being in contact with bottom surface of a swimming pool, said bracket being attached to said bottom side of said frame.

* * * * *